US007252365B2

(12) United States Patent
Yakubov et al.

(10) Patent No.: US 7,252,365 B2
(45) Date of Patent: Aug. 7, 2007

(54) METHOD AND APPARATUS TO REDUCE THE EFFECT OF INKJET DROP SATELLITES IN BI-DIRECTIONAL MULTI-PASS PRINTING

(75) Inventors: Igor Yakubov, Herzelia (IL); Matty Litvak, Tel Aviv (IL); Yosi Kaplan, Rishon Lezion (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 320 days.

(21) Appl. No.: 10/915,467

(22) Filed: Aug. 11, 2004

(65) Prior Publication Data

US 2006/0033772 A1 Feb. 16, 2006

(51) Int. Cl.
*B41J 2/15* (2006.01)
*B41J 2/145* (2006.01)

(52) U.S. Cl. ..... 347/41; 347/37

(58) Field of Classification Search ..... None
See application file for complete search history.

(56) References Cited

U.S. PATENT DOCUMENTS 5,426,457 A 6/1995 Raskin
5,635,967 A 6/1997 Klassen
5,661,507 A * 8/1997 Sperry ..... 347/9

* cited by examiner

*Primary Examiner*—Thinh Nguyen
(74) *Attorney, Agent, or Firm*—Thomas, Kayden, Horstemeyer & Risley, LLP

(57) ABSTRACT

A printing system and a method for printing in a multi-pass, bi-directional mode is provided. The method includes printing some boundary portions of an image in a first print-direction such that a non-printed area is traversed before a printed area and printing other boundary portions of the image in the opposite print-direction.

12 Claims, 7 Drawing Sheets

METHOD AND APPARATUS TO REDUCE THE EFFECT OF INKJET DROP SATELLITES IN BI-DIRECTIONAL MULTI-PASS PRINTING

BACKGROUND OF THE INVENTION

In bi-directional ink jet printing systems, printing is accomplished by traversing a print head from side to side across a print medium while in both traversals droplets of ink are ejected from the print head onto the print medium to form an image. The quality of the printed image, which is built up from thousands of ink dots is affected by the characteristics of the individual dots. Ideally, the dots should be perfect circular spots of dried ink having a uniform size and each dot should be positioned on its corresponding pixel without extending into the neighboring pixels.

In practice, the array of dots is not perfect and deviation from the theoretical shape, size, and position of the dots may lead to defects in the printed image. Defects in the printed image may occur due to irregularity in the movement mechanism of the print head and/or medium, differences in the spacing between nozzles and differences in their size, wet ink expanding onto an area having another color (inter-color bleeding), and defects caused by the satellites of ink droplets.

The formation of the ink satellites lowers the quality of the printed image, in particular for wide-format ink-jet printing applications, in which the print head is moved at relatively high speeds. The high speed creates aerodynamic resistance forces that may split the ejected ink drop to create additional satellites. The formation of ink satellites may narrow the inter-color gap, which is a gap between two printed areas, and may blur the boundary between adjacent areas having different colors. It would be beneficial to reduce or eliminate banding artifacts and defects caused by satellite of ink droplets and ink drop dislocation.

Ink jet print heads having multiple nozzles or arrays of nozzles usually exhibit cross talk between the nozzles, which may affect the print quality. The operation of a large number of nozzles simultaneously for longer period of times during printing may reduce problems associated with the nozzles. The number of parallel operative nozzles depends, however, on the image content, namely the amount and position of printed areas. It would be beneficial to use a method of organizing and optimizing the image content data such that most of the nozzles operate simultaneously.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanying drawings in which:

Figure 1:
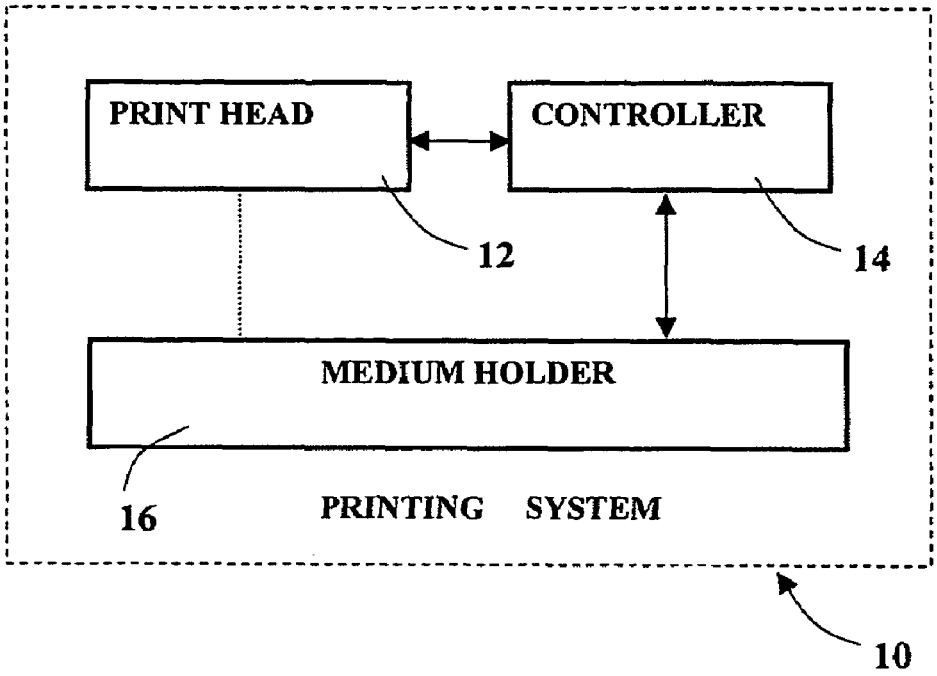
FIG. 1 is a schematic representation of a simplified printing system according to some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those of ordinary skill in the art that the present invention may be practiced without these specific details. In other instances, well-known methods, procedures, components and circuits have not been described in detail so as not to obscure the present invention.

Some embodiments of the present invention are related to a method for reducing the effect of inkjet drop satellites in bi-directional printing by identifying boundaries between different areas of an image. Certain boundaries may be printed by moving the print head in a first print-direction and other boundaries may be printed by moving the print head in the opposite print-direction based on the content of the image data associated with the boundaries. The term "boundary" as used herein throughout the specification and the claims may refer to a narrow boundary area on the print-medium or to a digital image data associated with the boundary between two areas. The boundary may have a width of two or more and may comprise two portions associated with the areas across the two sides of the boundary. The boundary may be a boundary between a printed area and a non-printed area, a boundary between areas of different color, a boundary between areas of different ink density, and any other boundary between areas having distinct image data as known in the art Reference is now made to FIG. 1, which is a block diagram of an exemplary inkjet printing system according to some embodiments of the present invention. Printing system 10 may comprise an ink jet print head 12, a controller 14 to control the operation of the printing system, and a print-medium holder 16. Print-medium holder 16 may be a drum, a flat bad, a conveying belt, a system of rolls, and any other suitable medium holder known in the art. A print-medium may be placed onto the medium holder 16 and may be moved in a first direction. Print head 12 may move in a scanning motion above the print-medium in a bi-directional mode perpendicular to the direction of movement of the print-medium as known in the art. The term "print-direction" as used herein refers to the direction of movement of the print head in one pass, which may be a left-to-right pass or the right-to-left pass.

Figure 2:
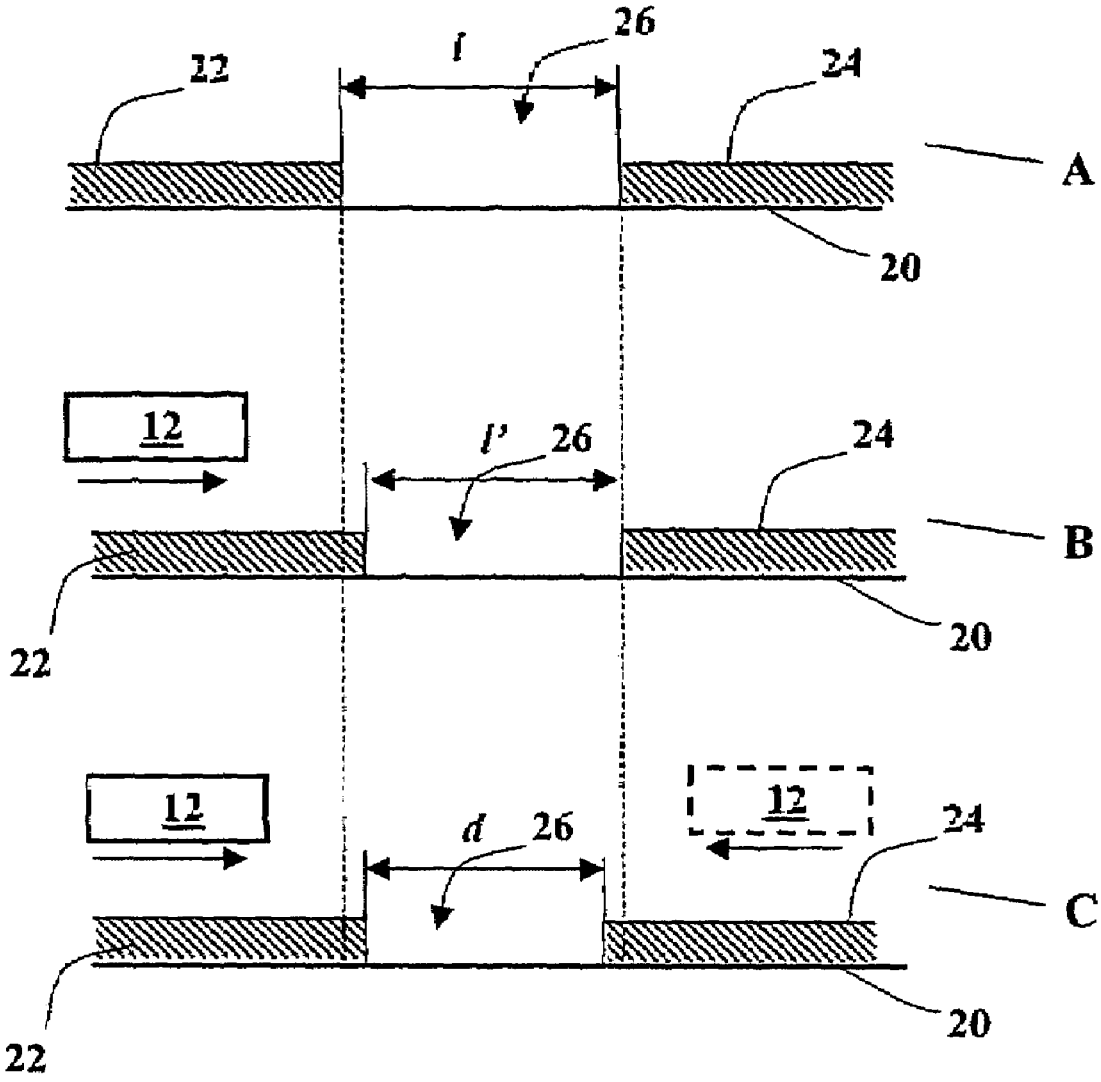
FIG. 2 is an illustration of an image printed on a print-medium, which demonstrates the phenomenon of narrowing a gap between printed areas and helpful in understanding embodiments of the present invention.

Reference is now made to FIG. 2, which is a three-portion illustration of an image printed on a print-medium 20 helpful in understanding embodiments of the present invention. The image comprises a first printed area 22, a second printed area 24 and a non-printed area, namely, a gap 26 between areas 22 and 24. The upper portion of the illustration designated A shows theoretical positions of areas 22 and 24 on medium 20 where the width of gap 26 has the desired value l. The middle portion of the illustration designated B shows the relative positions of areas 22 and 24 on medium 20 with reference to the theoretical positions for uni-directional printing. In the uni-directional mode, one edge of gap 26 may be shifted in the print-direction relative to its intended theoretical position so that gap 26 may narrow to a width l' smaller than width l. The lower portion of the illustration designated C shows the relative positions of areas 22 and 24 on medium 20 with reference to the theoretical positions for bi-directional printing. In the bi-directional mode, gap 26 may narrow from both edges of gap 26 to a width d smaller than width l'.

Figure 3:
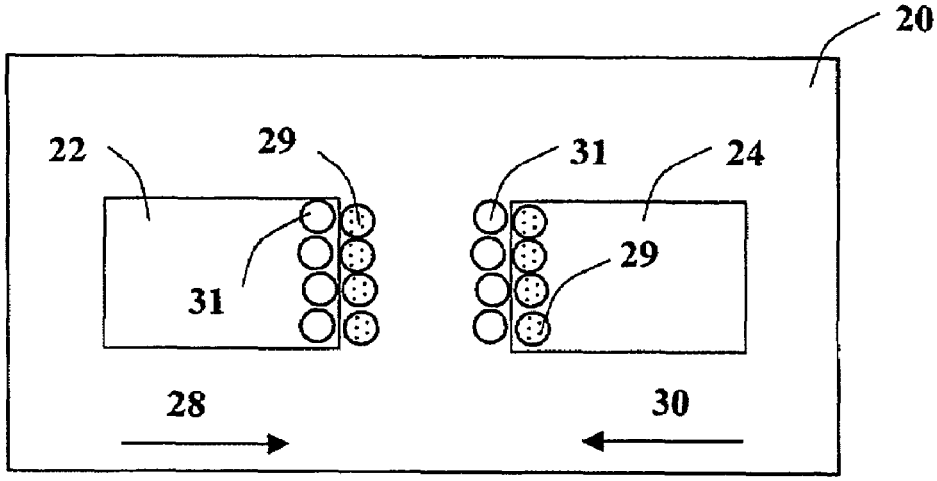
FIG. 3 is an illustration of an image printed on a print-medium, which demonstrates the phenomenon of narrowing a gap between printed areas due to satellites of ink droplets and helpful in understanding embodiments of the present invention.

The gap between two printed areas may be further narrowed due to satellite drops, which are separated from the ink droplets. Reference is now made to FIG. 3, which is an illustration of an image printed on a print-medium demonstrating the effects of satellite ink drops on narrowing of the gap between two printed areas. The movement of print head 12 in a first print-direction 28 may produce ink drop satellites illustrated as dotted circles 29 and the movement of print head 12 in the opposite print-direction 30 may produce ink drop satellites illustrated as blank circles 31.

Figure 4:
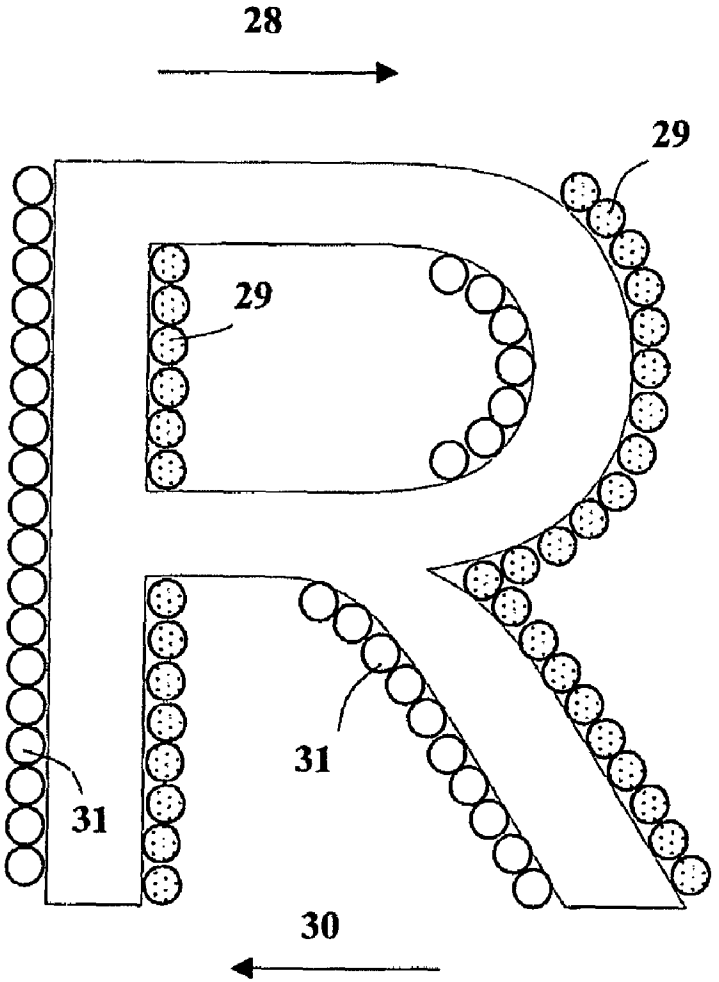
FIG. 4 is an illustration of an exemplary text character on a print-medium, which demonstrates the effect of satellites of ink droplets on the print quality and helpful in understanding embodiments of the present invention.

FIG. 4 illustrates a similar phenomenon for an exemplary text-character R printed in bi-directional printing mode on a print-medium. When print head 12 (not shown) moves in a first print-direction 28, drop satellites 29 land outside the boundaries of text-character R. When the print head moves in the opposite print-direction 30, drop satellites 31 land outside other boundaries of character R.

It should be understood to a person skilled in the art that embodiments of the present invention are not limited to black and white printing or text printing and similar patterns of drop satellites effects may be viewed in other types of printing such as line-art printing and color printing. Embodiments of the present invention are likewise applicable to any suitable type of inkjet printing. Some exemplary embodiments of the present invention are described below in relation to text printing.

Figure 5:
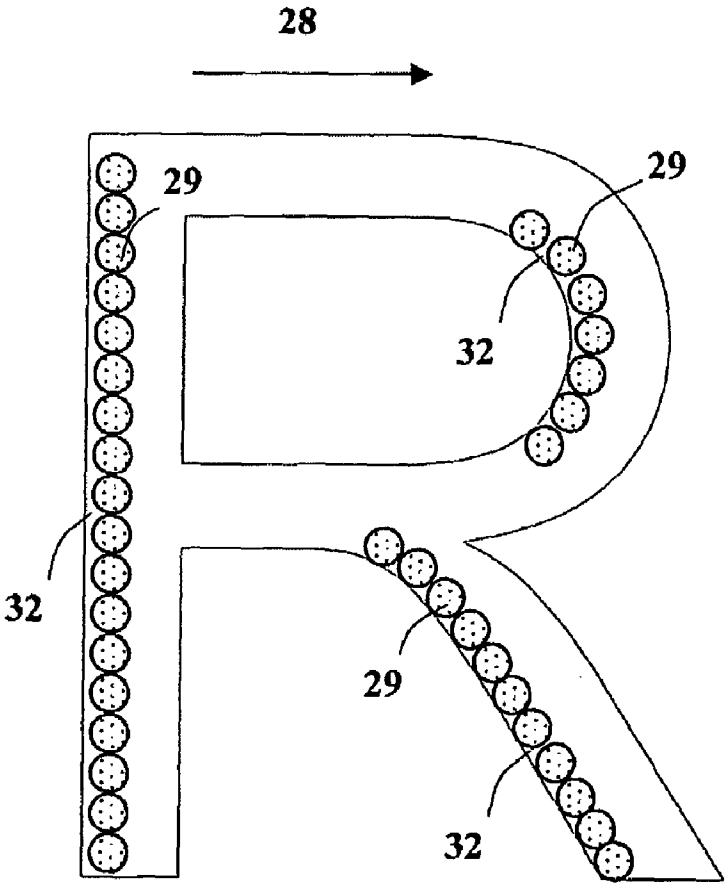
FIG. 5 is an illustration of boundary portions of the exemplary text character of FIG. 4, in which the boundary portions are printed in a first print-direction according to some embodiments of the present invention.
Figure 6:
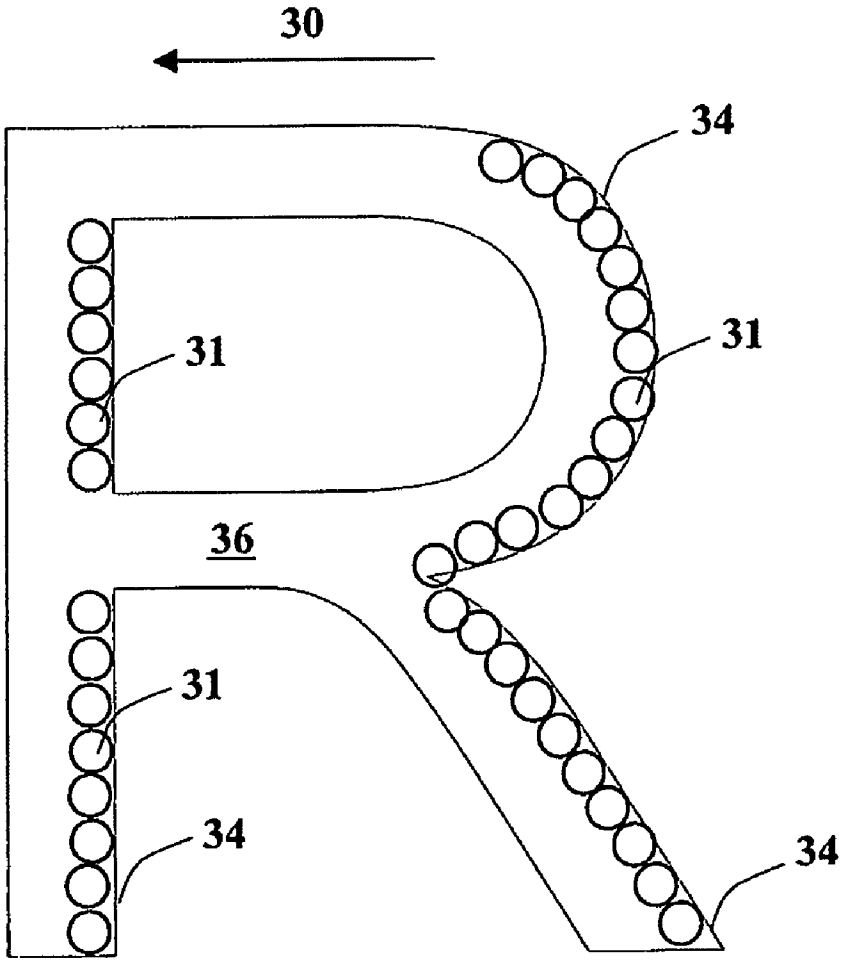
FIG. 6 is an illustration of other boundary portions of the exemplary text character of FIG. 4, in which the boundary portions are printed in a second print-direction according to some embodiments of the present invention.

Reference is now made to FIGS. 5 and 6, which are illustrations of the exemplary text-character R of FIG. 4 helpful in demonstration a method of bi-directional printing according to some embodiments of the present invention. Boundary portions 32 of text-character R are printed when the print head is moved in a first print-direction 28. As can be seen in FIG. 5, printing in print-direction 28 may produce ink satellites 29. When the print head is traversed in the first print-direction 28, only boundaries 32 in which the non-printed areas around character R are traversed prior to the printed areas of the boundary are printed. Therefore, ink drop satellites 29 may fall only onto desired areas, namely areas covered by ink.

Boundary portions 34 of text-character R are printed when the print head is moved in the opposite print-direction 30. As can be seen in FIG. 6, printing in print-direction 30 may produce ink satellites 31. When the print head is traversed in the opposite print-direction 30, only boundaries 34 in which the non-printed areas around character R are traversed prior to the printed areas of the boundary are printed. Therefore, ink drop satellites 31 may fall only onto desired areas, namely areas covered by ink. The inner portion 36 may be printed in a conventional bidirectional printing mode.

It should be noted that the thickness of the boundary portions might be represented in a vector representation of the character not along the print-direction. The thickness may be predetermined based on various factors such as speed of movement of the print head, ink viscosity, ink and ambient temperature and drop speed. The thickness may be in the order of one to five pixels.

Figure 7:
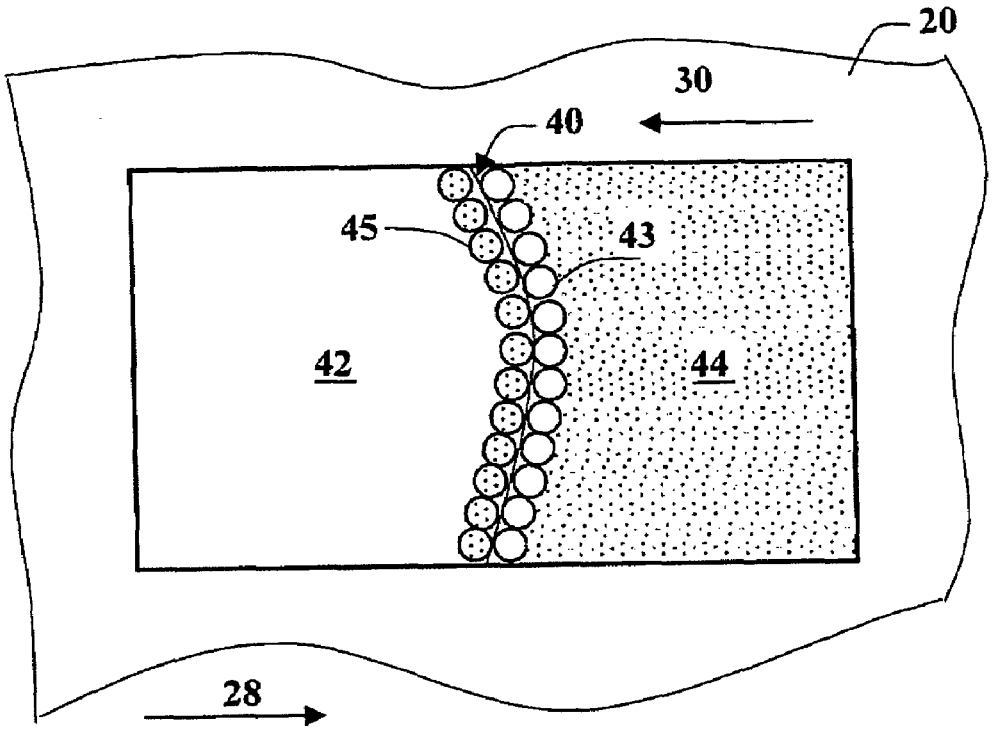
FIG. 7 is an illustration of a color image printed on a print-medium, which demonstrates the effect of satellites of ink droplets on a boundary between two colors and helpful in understanding embodiments of the present invention.

Reference is briefly made to FIG. 7, which is an illustration of a color image printed in bi-directional printing mode on a print-medium demonstrating the effect of satellites of ink droplets on a color boundary between two colors and helpful in understanding embodiments of the present invention. Boundary 40 is a boundary between a first area 42 printed in a first color and a second area 44 printed in a second color. Boundary 40 has a width of approximately two or more pixels and comprises two adjacent portions, each associated with one of the colors of areas 42 and 44. When print head 12 (not shown) moves in the first print-direction 28, ink droplet satellites 43 associated with the first color may land across the boundary 40 onto the second area 44 covered by ink of the second color. When the print head moves in the opposite print-direction 30, ink droplet satellites 45 associated with the second color may land across boundary 40 onto the first area 42 covered by ink of the first color. The landing of the ink satellite drops on both sides of the boundary may blur the boundary and may cause undesired and uncontrolled color changes in the image portions, which are adjacent to the boundary.

Figure 8:
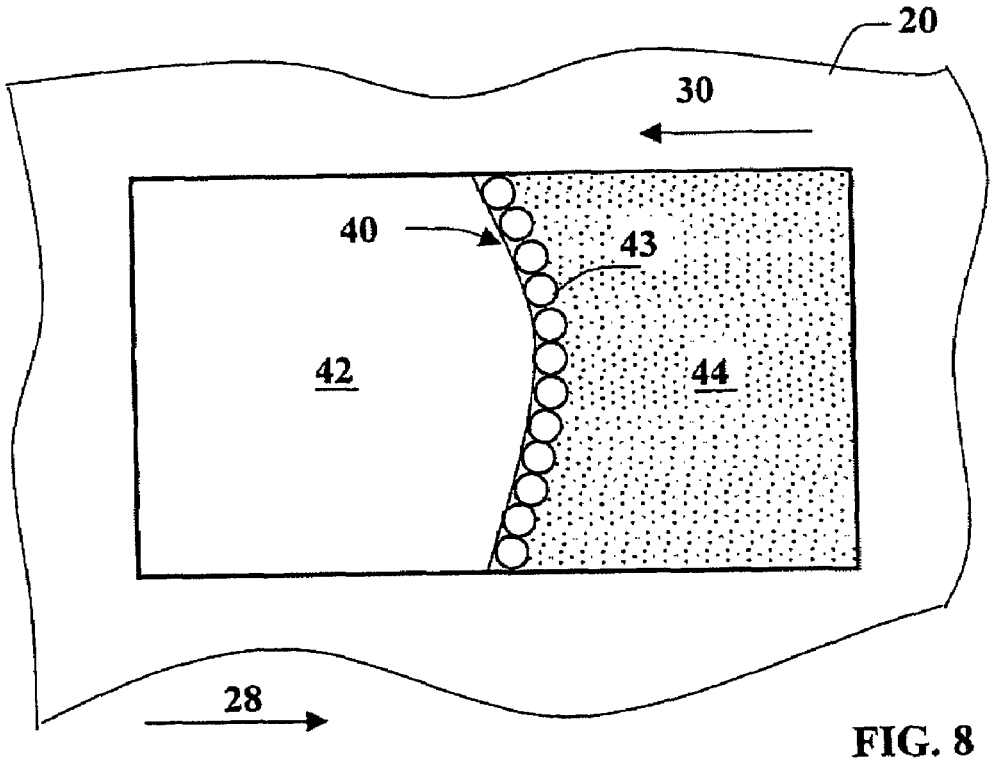
FIG. 8 is an illustration of the image of FIG. 7, in which a portion of the boundary comprised of a first color is printed in a first print-direction according to some embodiments of the present invention.

FIG. 8 is an illustration of the color image of FIG. 7, in which a portion of the boundary comprised of the second color is printed in a first print-direction according to some embodiments of the present invention. In accordance with embodiments of the present invention the second-color portion of boundary 40 is printed when the print head is moved in the first print-direction 28. As can be seen in FIG. 8, printing in print-direction 28 may produce ink satellites 45 of the second-color ink, which land onto area 44 covered by the second-color ink.

Figure 9:
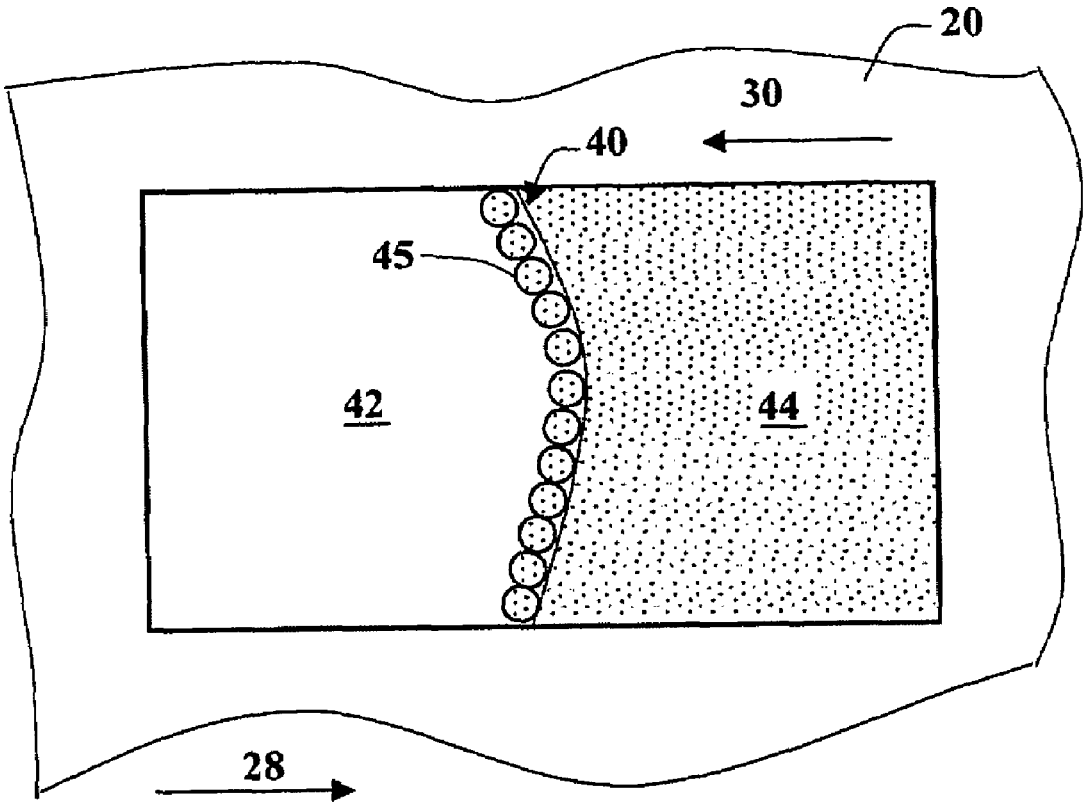
FIG. 9 is an illustration of the image of FIG. 7, in which the adjacent portion of the boundary comprised of a second color is printed in a second print-direction according to some embodiments of the present invention.

FIG. 9 is an illustration of the color image of FIG. 7, in which the adjacent portion of the boundary comprised of the first color is printed in the opposite print-direction according to some embodiments of the present invention. In accordance with embodiments of the present invention the first-color portion of boundary 40 is printed when the print head is moved in the opposite print-direction 30. As can be seen in FIG. 9, printing in print-direction 30 may produce ink satellites 43 of the first-color ink, which land onto area 42 covered by the first-color ink. The printing method described above may sharpen the boundary between colors and may reduce undesired color changes in sections of the image adjacent to color boundaries.

Figure 10:
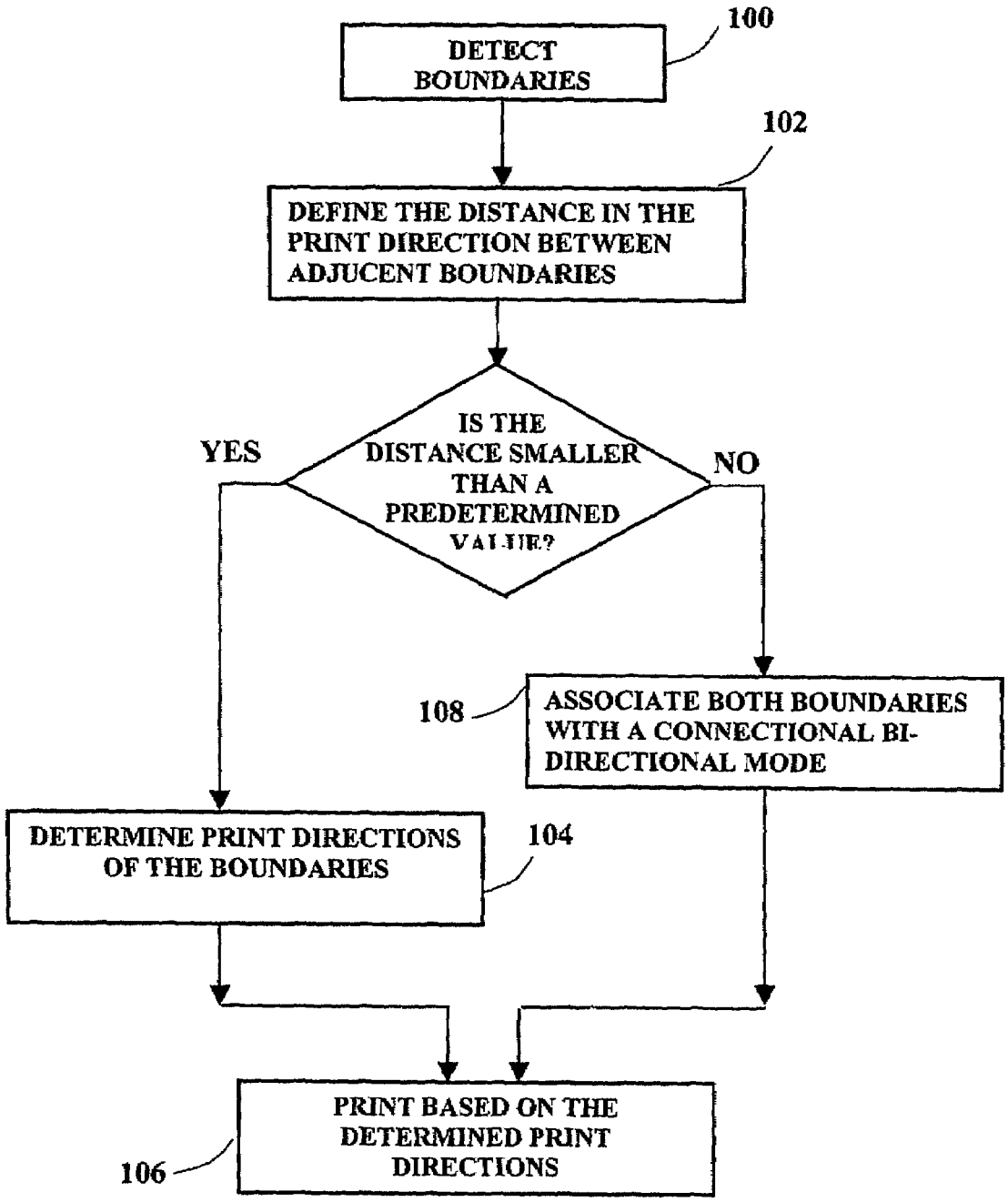
FIG. 10 is a flow chart diagram of a method of bi-directional printing according to some exemplary embodiments of the present invention.

The operation of printing system 10 in conjunction with embodiments of the present invention is better understood if reference is made to FIG. 10, in which a schematic flowchart illustration describes a method of bi-directional printing according to some embodiments of the present invention. Controller 14 may process the image data to detect boundaries (block 100). Any known edge-detection algorithm may be used for this purpose, for example a Laplacian derivative kernel using "zero-crossing" technique. Additionally, a combined pair of 5×5 Sobel-like filters may be used, if desired.

Next, controller 14 may determine the distance in the print-direction between adjacent boundaries (block 102). If the distance exceeds a predetermine value, the print-directions of the boundaries are determined (block 104). The controller may determine which of the detected boundaries will be printed in a first print-direction, and which of the detected boundaries will be printed in the opposite print-direction. The controller may also associate the inner portions of the image with a conventional bi-directional mode.

The image is printed onto a print-medium according to the determined print-directions of the boundaries (block 106). If the distance is below the predetermined value, these boundaries are printed in a conventional bi-directional mode (block 108). As an exemplary illustration, the printing process in multi-pass, bi-directional mode of the text character R of FIGS. 4-6 is now described. The print head may traverse across the print medium in a first print direction 28 (left-to-right pass) to print parts of boundaries 31 and a first impression of the inner portions of the text character that belong to a particular swath without printing parts of boundaries 32. Then, the print head may traverse in the opposite direction 30 (right-to-left pass) to print parts of boundaries 32 and a second impression of the inner portions of the text character that belong to that swath without printing parts of boundaries 31.

A software program implementing the method of FIG. 10 may be stored in a program memory and executed by a processor coupled to the program memory.

It is well known in the art that inkjet print heads operate better when all of the nozzles are operative. It is well known in the art that the quality printing is higher if all the nozzles of an inkjet print head are operative simultaneously. In conventional bi-directional printing, some of the printed dots forming a boundary mat be printed when the print head moves in a first print-direction and others when the print head moves in the opposite print-direction. This mode of printing may reduce the number of nozzles operating simultaneously.

It should be understood to a person skilled in the art that when a boundary between two colors is printed according to embodiments of the present invention all the dots pertaining to one-colored area of a boundary are printed when the print head moves in one print-direction. Thus most of the nozzles may operate simultaneously to further improve the print quality of the boundary.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A method for printing in a multi-pass, bi-directional mode, the method comprising:

detecting the first boundary portion based on digital data of the image;

determining the first direction based on image data of said first boundary portion:

printing a first boundary portion of an image on a print-medium by traversing a print head across the print-medium in a first direction such that a non-printed area is traversed before a printed area; and printing on the print-medium an inner portion of the image by traversing the print head across the print-medium in both the first direction and a second direction opposite the first direction.

2. The method of claim 1 comprising:

printing a second boundary portion of the image on the print-medium when the print head is traversed in the second direction.

3. A method for printing in a multi-pass, bi-directional mode, the method comprising:

detecting a boundary between two areas of an image based on digital data of the image;

determining a print-direction of the boundary based on image data of said areas.

4. The method of claim 3 further comprising:

printing the boundary such that a print head is traversed in the print-direction across a portion of a print-medium associated with the boundary, while selectively ejecting droplets of ink onto the portion to print the boundary.

5. The method of claim 4, wherein the boundary is between a printed area and a non-printed area and the print-direction is such that the non-printed area is traversed by the print head prior to the printed area.

6. The method of claim 4, wherein the boundary is between areas of different colors and the print-direction is such that the non-printed area is traversed by the print head prior to the printed area.

7. The method of claim 3 further comprising:

determining the distance in the print-direction between two adjacent boundaries.

8. A method for printing in a multi-pass, bi-directional mode, the method comprising:

traversing a print head in a first direction across a print-medium while selectively ejecting droplets of ink onto a first portion of said print-medium to print a first impression of an inner portion of an image and onto a second portion of said print-medium to print a boundary portion of said image; and traversing the print head in a second direction, opposite the first direction, across the print-medium while selectively ejecting droplets of ink onto the first portion of said print medium to print a second impression of the inner portion of the image without printing onto the second portion of the print-medium, wherein the boundary portion is associated with a boundary between areas of different color and traversing the print head in the first direction comprises traversing the second portion such that a first color area is traversed prior to a second color area of the boundary without ejecting droplets of ink corresponding to the first color.

9. The method of claim 8, wherein the boundary portion is associated with a boundary between a printed area and a non-printed area and traversing the print head in the first direction comprises traversing the second portion such that the non-printed area is traversed prior to the printed area of the boundary.

10. The method of claim 8, wherein the boundary portion is associated with a boundary between two areas of different ink density and traversing the print head in the first direction comprises traversing the second portion such that a low-density area is traversed prior to a high-density area of the boundary.

11. The method of claim 8, wherein traversing the print head in the second direction comprises selectively ejecting droplets of ink onto another boundary portion of said print medium to print a third portion of said image.

12. An inkjet printing system comprising:

a controller to detect a boundary between two areas of an image based on digital data of the image and to determine a print-direction of the boundary based on image data of said areas; and a bi-directional print head coupled to said controller to print on a print-medium a portion associated with the boundary while traversing the print-medium in the print-direction.

* * * * *

UNITED STATES PATENT AND TRADEMARK OFFICE

CERTIFICATE OF CORRECTION

PATENT NO. : 7,252,365 B2
APPLICATION NO. : 10/915467
DATED : August 7, 2007
INVENTOR(S) : Igor Yakubov et al.

It is certified that error appears in the above-identified patent and that said Letters Patent is hereby corrected as shown below:

In column 6, line 14, in Claim 1, delete "portion:" and insert -- portion; --, therefor.

Signed and Sealed this

Twelfth Day of August, 2008

JON W. DUDAS
*Director of the United States Patent and Trademark Office*